US005803636A

United States Patent [19]

Legrain et al.

[11] Patent Number: 5,803,636

[45] Date of Patent: Sep. 8, 1998

[54] APPLICATOR FOR THERMOPLASTIC PRODUCT, PARTICULARLY DEPILATORY WAX

[75] Inventors: Marc Legrain, Civrieus en Dombres; Jean Berthier, Villefranche sur Saone, both of France

[73] Assignee: Seb S.A., Ecully, France

[21] Appl. No.: 792,675

[22] Filed: Jan. 29, 1997

[30] Foreign Application Priority Data

Jan. 29, 1996 [FR] France ..... 96 01364

[51] Int. Cl.[6] ..... A45D 40/00; A45D 40/26; A45D 34/04

[52] U.S. Cl. ..... 401/1; 401/2; 401/219; 401/220

[58] Field of Search ..... 401/1, 2, 219, 401/220

[56] References Cited

U.S. PATENT DOCUMENTS

| | | |
|---|---|---|
| 1,421,811 | 7/1922 | Muller . |
| 2,028,084 | 1/1936 | Brown . |
| 2,732,575 | 11/1956 | Faust . |
| 2,762,072 | 9/1956 | Madalinski . |
| 3,048,880 | 8/1962 | Slomon . |
| 3,100,908 | 8/1963 | Engle . |
| 5,395,175 | 3/1995 | Bontoux et al. . |
| 5,556,468 | 9/1996 | Legrain et al. . |

FOREIGN PATENT DOCUMENTS

| | | |
|---|---|---|
| A-0 592 340 | 4/1994 | European Pat. Off. . |
| A-2 706 261 | 12/1994 | France . |

*Primary Examiner*—Steven A. Bratlie
*Attorney, Agent, or Firm*—Pillsbury Madison & Sutro LLP

[57] ABSTRACT

An applicator for a thermoplastic product, the applicator including: a housing (1) constructed to be held by a user and having a longitudinal axis and an end provided with two mutually parallel longitudinal walls **(11*b*) and two transverse walls (11*c*) delimiting a product outlet opening (20); a reservoir (2) for holding the product, the reservoir being installed in the housing, being constructed to be in thermal communication with a heating unit (4) and being open at one end to permit product in the reservoir to flow into the product outlet opening; an applicator roller (15)** located in the product outlet opening and having an axis of rotation which is parallel to the longitudinal walls; and a mechanism for displacing the applicator roller parallel to the longitudinal axis of the housing in order to vary the thickness of a slit through which the thermoplastic product flows out of the applicator.

10 Claims, 3 Drawing Sheets

APPLICATOR FOR THERMOPLASTIC PRODUCT, PARTICULARLY DEPILATORY WAX

BACKGROUND OF THE INVENTION

The present invention relates to the field of devices for applying depilatory wax, in which the wax, stored in a solid state at room temperature, must be heated in order to undergo a change of state to an at least pasty state in order to be applied.

The invention concerns more particularly a depilatory wax applicator comprising a housing constructed to be held in the hand of the user, and at the interior of which is provided a reservoir for the wax product, the reservoir being capable of being placed in thermal communication with heating means, as well as an applicator roller disposed across an outlet opening of the reservoir. This roller permits heated wax to be spread in a layer or thin strip as the roller is caused to roll on a surface, for example a skin surface, during a translational movement of the applicator itself.

French patent document A-2 520 601 discloses a casing provided with heating sleeves in which are housed several manual applicators intended to be employed by a user. Each applicator is provided with an internal depilatory wax reservoir which is closed by an applicator roller surrounded by walls whose two longitudinal wiping sides define two outlet spaces controlling the flow of the molten wax on the roller, and thus the thickness of the spread layer.

However, the temperature of application of the wax is not well maintained to the extent that the wax is only heated in a discontinuous manner and only when the applicator is in a sleeve. After a certain period of use, the temperature of the wax decreases rapidly within the reservoir, causing its spreading to be more difficult, resulting in a wax thickness which is not well controlled and the appearance of a phenomenon of formation of wax threads.

In addition, this known device is preferably provided with three different applicators: a wide applicator for legs, a medium applicator for the body and a narrow applicator for the face.

European patent document A-0 368 698 describes a manual applicator comprising, in a single housing, a wax reservoir, a heating resistance and an applicator roller. In order to improve the ease of application of the wax, but also to attempt to better maintain the temperature of the wax, the applicator roller is provided with an autonomous heating means. However, this complementary means can present the risk of burning of the skin, and causes the fabrication of the applicator to be more difficult.

The commonly owned French patent document 2 706 261 describes an applicator similar to the preceding one in which the roller comprises an aluminum core thermally linked by bearings to the heated body of the reservoir, and the roller is coated with a plastic material to allow an improved transporting and depositing of the melted wax.

More particularly, in this applicator the roller is removably mounted in lateral clips in order to permit access to the reservoir for refilling purposes. In a modified form of construction, this roller is mounted on an internal slide unit of the reservoir which can be withdrawn by a translational movement, but always solely for the function of refilling the reservoir.

However, in the devices described above, the dimensions and the materials of the applicator roller, as well as the means for heating the applicator, are essentially optimized for the application of a layer having a precisely predefined thickness based on a predetermined wax composition. The formula for this wax is normally developed in such a manner that the depilation results are fairly satisfactory for the legs, the armpits and the face. However, in practice, it is noted that the results remain insufficient with respect to the demands of the users for each of the zones of the body: either the wax may cause burning, or it is difficult to cause the wax to flow, or the wax layer is too thick or too thin and as a result fails to remove all of the hairs.

SUMMARY OF THE INVENTION

An object of the present invention is to provide an applicator which permits the achievement of a clearly more effective depilatory operation for each part of the body.

Another object of the invention is to provide an applicator having a great flexibility in use, particularly in permitting the spreading of wax of different compositions, possibly at different temperatures, all while remaining easy to use.

A further object of the invention is to provide a structure which remains simple so that operation will be reliable on a long-term basis and so that fabrication and assembly costs remain at acceptable levels.

The above and other objects are achieved, according to the invention by an applicator for thermoplastic products, including depilatory wax, comprising a housing forming a means for holding the applicator, at the interior of which housing there is provided a reservoir for a product capable of being placed in thermal communication with heating means, as well as a roller disposed in an outlet opening of the reservoir, the opening being of rectangular form. The applicator comprises means which permit adjustment of the height of the roller with respect to the fixed geometry of the longitudinal walls of the opening. In particular, in accordance with the invention, the means for adjusting the height of the roller comprise a slide which is moveable at the interior of the opening of the reservoir in a direction parallel to the longitudinal axis of the applicator, this slide supporting the moveable roller for rotation and presenting one or several external elastic projections, each entering into a notch of a series formed in a corresponding wall of the opening, or conversely elastic projections belonging to the walls.

Objects according to the invention are further achieved by an applicator for a thermoplastic product, including depilatory wax, comprising a housing A forming a means by which the housing may be held, and at the interior of which housing is provided a reservoir for the product capable of being placed in thermal communication with heating means, as well as a roller disposed in an outlet opening of the reservoir, the opening having a rectangular form. The applicator also comprises means of permitting adjustment of the height of the roller with respect to the fixed geometry of the longitudinal walls of the opening. In particular accordance with the invention, the means for adjusting the height of the roller include two grooves arranged opposite one another in lateral walls of the opening and extending parallel to the longitudinal axis of the applicator, these grooves receiving the extremities of the shaft, or bearings, of the roller, as well as a pair of identical lateral arms joined together by a cross-piece and moveable in rotation at one of their extremities, each arm being adjacent a groove and engaging by an oblique opening arranged in their other extremity the corresponding bearing of the roller.

This adjustment permits first of all to spread a layer of wax in different thicknesses depending on the area being treated. This layer is preferably thicker in areas where the skin is supple such as the armpits, and thinner in the zones where the skin is firmer such as on the legs.

All things being moreover equal, an increase in the cross-section of the outlet openings permits application of a liquid wax at a temperature slightly lower than normal. An adjustment of the outlet cross-sectional also permits the possibility of working with waxes having different compositions, better adapted to one part or the other of the body, but not having the same viscosity or the same coefficient of surface tension either relative to the covering of the rotating element or relative to the hair. This adjustment also permits the possibility, for the same wax, of interchanging one rotating element for another having a different surface covering, or having channels or grooves, also optimized with respect to the part of the body to be treated.

According to a preferred embodiment of the invention in which the rotating applicator part is a roller disposed in a reservoir outlet opening of rectangular cross-section, the adjustment of the cross-section of the wax outlet spaces, or gaps, between the roller and the longitudinal walls of the opening is effected by an adjustment of the height of the roller with respect to the fixed geometry of the longitudinal walls of the opening, the lateral circular faces of the roller remaining in frictional contact with the lateral walls of the opening. This adjustment mechanism has proven to be particularly simple to achieve due to the fact that it is only necessary to displace a single internal part.

According to a first form of construction of applicators according to the invention, the longitudinal walls of the opening are substantially parallel to the longitudinal axis of the applicator, and the height of the axis of the roller can be placed at least at a level with the external extremity of the walls, or even thereabove. Then, variations in the width of the outlet space per unit of height displacement of the roller depends essentially on the diameter of the roller.

According to a second preferred modification of the invention, the longitudinal walls are conical, or inclined, with respect to the longitudinal axis of the applicator. The variations in width of the space per unit of height displacement of the roller can even be better mastered and refined to the extent that they are dependent on the diameter of the roller and the slope of the walls.

Preferably, the inclined longitudinal walls of the outlet opening are oriented toward the exterior of the applicator. Then, raising of the roller implies an increase in the width of the space. In addition, the roller would protrude to a greater extent and can penetrate more easily into body recesses. Finally, the path of travel of the wax on the roller is slightly longer.

Alternatively, the inclined longitudinal walls of the opening are oriented toward the interior of the applicator. Then, a raising of the roller can produce a reduction in the width of the space, which can even amount to a nearly complete closing of the opening, which can prove to be momentarily useful if it is desired to maintain the applicator in its application orientation even if it is no longer in use. The path covered by the wax on the roller is then a little shorter.

According to a first embodiment of the invention, the means for adjusting the height of the roller comprise a slider which is moveable at the interior of the reservoir opening parallel to the axis of the applicator, this slider supporting the rotatable roller and having one or several external elastic projections, each entering into a notch of a series of notches arranged in the corresponding wall of the opening, or vice-versa: the elastic projections then forming part of the walls.

According to a second embodiment of the invention, the means for adjusting the height comprise two grooves arranged opposite one another in each of the lateral walls of the opening and extending parallel to the longitudinal axis of the applicator, these grooves receiving the extremities of the axis, or bearings, of the roller, as well as a pair of identical lateral arms secured together by a crosspiece and moveable in rotation at one of their extremities, each arm being adjacent to a groove and engaging by an oblique opening arranged in its other extremity a corresponding roller bearing. Thus, by rocking the pair of arms from one side to the other, the roller can be forced to rapidly rise or descend from one end to the other of the grooves where it is then maintained.

In a complementary manner, the grooves receiving the roller bearings are partially duplicated in an intermediate slider moveable at the interior of the reservoir opening parallel to the longitudinal axis of the applicator, this slider supporting the roller which is moveable in rotation. The intermediate slider permits removal of the roller for access to the reservoir in order to refill it. The arms can then be at the interior or the exterior of the slider.

In other words, the adjustment of the cross-section of the wax outlet spaces permits adjustment of the applicator in the same manner as one adjusts photographic equipment to the sensitivity of a film provided for one situation or another.

The invention will be better understood from a description of preferred embodiments, given solely by way of non-limiting and illustrative example, and shown in the attached drawings.

DESCRIPTION OF THE PREFERRED EMBODIMENTS

Figure 1A:
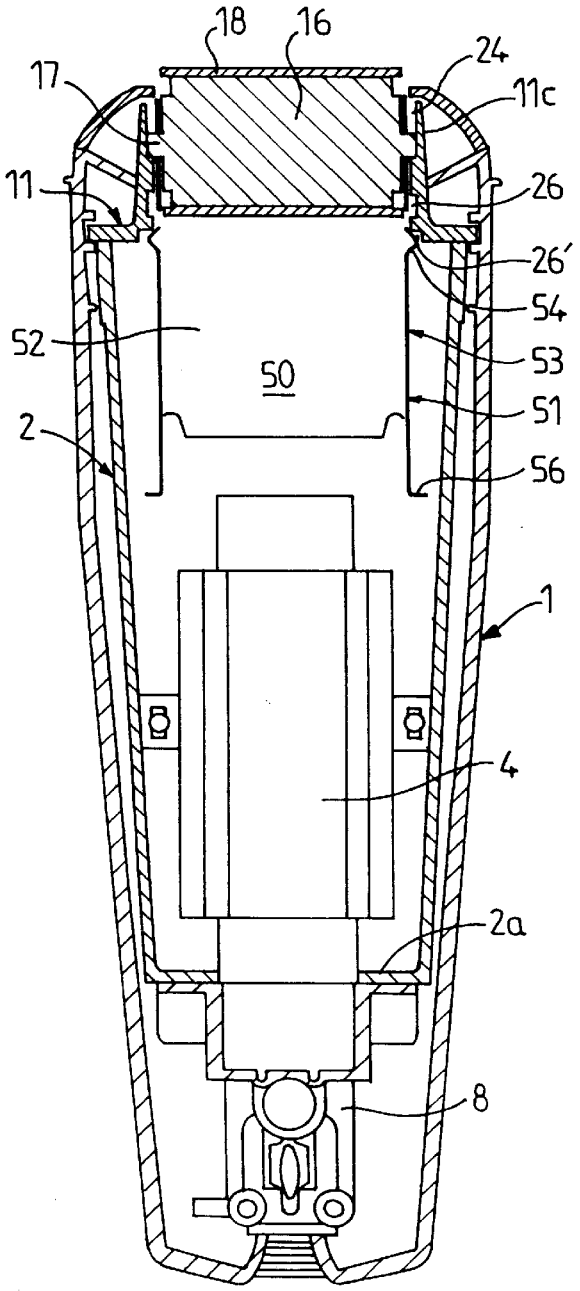
FIGS. 1*a* and 1*b* are elevational cross-sectional views, respectively from the front and the side, of a first embodiment of an applicator according to the invention provided for applying a thin layer of wax.

The applicator for a thermoplastic product shown in FIGS. 1*a*, 1*b*, 2*a* and 2*b* is typically provided for the application of depilatory wax and comprises a housing 1 made, for example, of a plastic material, this housing presenting a generally elongated form. The transverse cross-section of this housing can have any suitable form, for example circular, and itself defines the holding means which allows the user to manually grip the applicator.

At the interior of the housing is installed a reservoir 2, preferably made of a material which is a good conductor of heat, such as aluminum. Reservoir 2 is provided to hold and store a quantity of the thermoplastic product which is to be applied. Reservoir 2 extends substantially over the entire central portion of housing 1 in the direction of its longitudinal axis, and includes a bottom 2*a* and, at its top, an opening 2*b*. This reservoir is provided in its central zone with a fin 3 for diffusing heat, the fin extending into the internal volume of reservoir 2 starting from bottom 2*a*.

Reservoir 2 is in thermal communication with heating means 4, constituted for example of an electric resistance or an element having a positive temperature coeffient at least partially surrounding reservoir 2, or, as illustrated, firmly secured to one wall of reservoir 2. Heating means 4 are associated in a conventional manner with temperature regulation means such as a thermostat 6*a* and a fuse 6. The applicator is also provided with an indicator light 7 for monitoring the delivery of electrical energy to heating means 4, the indicator light being visible from outside housing 1 via a window arranged therein. The electrical system, including the electrical connection to a power cord and elements for securing the power cord (not shown) in housing 1, are mounted on a support element 8 housed in the lower part of housing 1, beneath reservoir bottom reservoir 2.

The upper zone of housing 1 is constituted by a head 11, for example, screwed onto the upper part of reservoir 2 in the area of opening 2*b*. Like reservoir 2, head 11 is also made of a material which is a good conductor of heat, such as aluminum. The upper walls 11*b* and 11*c* of head 11 delimit a geometric envelope having a substantially rectangular outline, or cross section, and constituting the outlet opening 20 of reservoir 2.

The applicator for thermoplastic product also comprises an applicator roller 15 housed in the opening 20 with its axis of rotation, on the one hand, perpendicular to the longitudinal axis of the applicator and, on the other hand, parallel to the longitudinal walls 11*b* of opening 20.

Roller 15 is constituted, in this case, of a cylindrical core 16 of circular cross-section and made of a material which is a good conductor of heat, such as aluminum, core 16 being provided on each of its lateral faces with a journal pin 17. Pins 17 may be formed, for example, by cutting, or machining, the ends of core 16. Pins 17 extend along the central axis of rotation of applicator roller 15. Core 16 is coated or otherwise covered around its entire periphery by a coating or covering 18 of an overmolded plastic material selected to have good gripping properties with respect to the wax that is to be applied.

The circular lateral faces of applicator roller 15 are practically in frictional contact with lateral walls 11*c* of outlet opening 20 while pins 17 are engaged in grooves, or slots, 24 which are open at their upper end and are formed in the thickness of each of lateral walls 11*c*. Grooves 24 extend parallel to the longitudinal axis of housing 1, which is the vertical direction in FIGS. 1*a*, 1*b*, 2*a* and 2*b*. Thus arranged, applicator roller 15 permits the flow of wax firstly along a slit, or gap, 22 formed between the outer surface of applicator roller 15 and the internal face of one of the longitudinal walls 11*b*, and then on the outer surface of covering 18.

More particularly according to the invention, applicator roller 15 is in fact mounted to be moveable with respect to housing 1, on the one hand between an operating position for applying a film of wax within outlet opening 20 and a disengagement position outside of this opening to permit the filling or refilling of reservoir 2; and on the other hand between different positions within outlet opening 20 to permit adjustment of the thickness of slit 22.

For these purposes, applicator roller 15 is fastened to a slider 50 which is displaceable along walls 11*b* and 11*c* of head 11, which walls form the upper part of housing 1. The slider 50 comprises two parallel legs 51 rigidly connected together by a crosspiece, or bridge, 52. Each leg 51 is provided at its upper end with a through hole, the through holes on the two legs 51 being in alignment with one another, for receiving and supporting bearings for pins 17. Each leg 51 has in its central portion an elastic blocking tongue 53 formed as a cut-out portion of the associated leg 51 and terminating at its upper end in a projection 54 oriented away from the region enclosed by legs 51. Each projection 54 is intended and dimensioned to come to engage, when slider 50 is in a working position within outlet opening 20, either under the lower edges 26' of lateral walls 11*c* (lowered position of pins 17), or in one pair of a series of mutually opposed pairs of blocking notches 26 (only one pair being shown), the pairs of notches being arranged in parallel in internal faces of lateral walls 11*c* (raised position of pins 17). In the first case, applicator roller 15 is guided by vertical grooves 24 formed in lateral walls 11*c*. Projections 54, on the one hand, and edges 26' and notches 26, on the other hand, thus constitute respective components of detent means for holding slider 50 in a selected one of a plurality of positions which are spaced apart along the longitudinal axis of the applicator.

Blocking tongues 53 have an elasticity sufficient to allow them to be deflected toward the region enclosed by slider 50 when a pulling force is exerted on applicator roller 15, this deformation of tongues 53 permitting withdrawal of projections 54 past lower edges 26' or a pair of notches 26. Slider 50 can then be completely withdrawn through outlet opening 20 out of housing 1 to permit filling of reservoir 2 with a fresh supply of wax, or can be placed in a second position in which projections 54 come to engage in other pair of notches 26 of the parallel series of pairs of notches.

More particularly according to the invention, the portions of the longitudinal walls 11*b* which cooperate with applicator roller 15 are beveled portions 28 which are inclined upwardly and away from applicator roller 15. As a result, a change in the longitudinal position of slider 50, by moving projections 54 into an appropriate set of notches 26, results in a modification of the location of the diametrical cross section of applicator roller 15 with respect to beveled portions 28, which consequently modifies the thickness of slits 22.

In the absence of beveled portions, the length of slider 50 is preferably selected so that when projections 54 are beneath lower edges 26', a diarnetral plane of applicator roller 15 which passes through its axis of rotation is located at the same level as the external edges of 11*b*. Then, any displacement of projections 54 into successive pairs of notches 26 progressively opens the slit 22 between lateral walls 11*c* and applicator roller 15, while applicator roller 15 comes to protrude to an increasing extent out of housing 1.

Conversely, it can be envisioned that the external edges of longitudinal walls 11*b* will be formed to slope upwardly slightly toward the interior, or slightly toward applicator roller 15. In this case, an upward displacement of applicator roller 15 by movement of projections 54 from one pair of notches 26 to another reduces the thickness of slit 22 to a point at which, if desired, one or both slits 22 are closed.

Moreover, slider 50 is provided, at the lower end of each leg 51, with external abutments 56 disposed to come into engagement against lower edges 26' of lateral walls 11*c*. These abutments prevent complete extraction of slider 50 when it is in its completely withdrawn position outside of outlet opening 20 for purposes of supplying thermoplastic material to reservoir 2.

It is in order to note that such an arrangement of applicator roller 15 by means of slider 50 does not diminish the transmission of heat energy to core 16 because, in all positions of the assembly, the pins 17 remain engaged in the grooves 24 formed in the aluminum lateral walls 11*c* of head 11.

The thermoplastic product applicator according to the invention operates in the following manner. The user proceeds first of all to extract applicator roller 15 in order to expose the interior of reservoir 2 for purposes of confirming that it contains an appropriate quantity of depilatory wax. To do this, the extraction can take place manually or with the aid of a gripper (not shown but disclosed in U.S. Pat. No. 5,556,468) which is formed to grasp applicator roller 15 via circular lips forming a region of excess thickness with respect to the surface of the lateral walls. By pulling on applicator roller 15, projections 54 are caused to leave the notches 26 or lower edges 26' with which they were previously engaged and the user can then cause slider 50 to slide along with walls of head 11, pins 17 of applicator roller 15 sliding out of grooves 24. This displacement is continued until the abutments 56 come to bear against lower edges 26'.

Figure 1B:
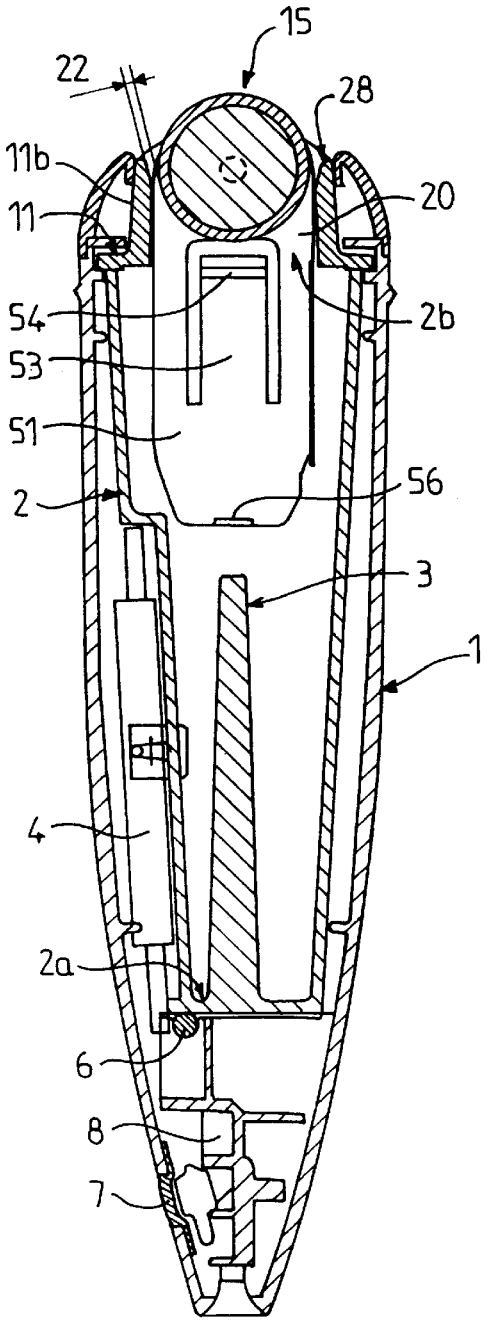

After having proceeded with filling of reservoir 2, if necessary, slider 50 is moved back down through outlet opening 20 while reintroducing pins 17 of applicator roller 15 into grooves 24. A pressing force imposed on applicator roller 15 forces the tongues 53 to move together momentarily until projections 54 come to engage under lower edges 26', as shown in FIGS. 1*a* and 1*b*.

After the electrical plug at the end of the power cord of the applicator is connected to a wall outlet, the wax contained in reservoir 2 is heated and melts to progressively assume the liquid or softened state. The user then tilts the applicator to place applicator roller 15 in contact with the surface to be treated and then moves the applicator in order to roll applicator roller 15 over the skin surface. The melted or softened wax passes between legs 51 of slider 50 and reaches the forward part of applicator roller 15 and then slit 22. Slit 22 acts as a calender in that it limits the thickness of the layer of wax carried by covering 18 of applicator roller 15. This wax spreads in the form of a band during progression of the applicator along the zone of body being treated.

Figure 2A:
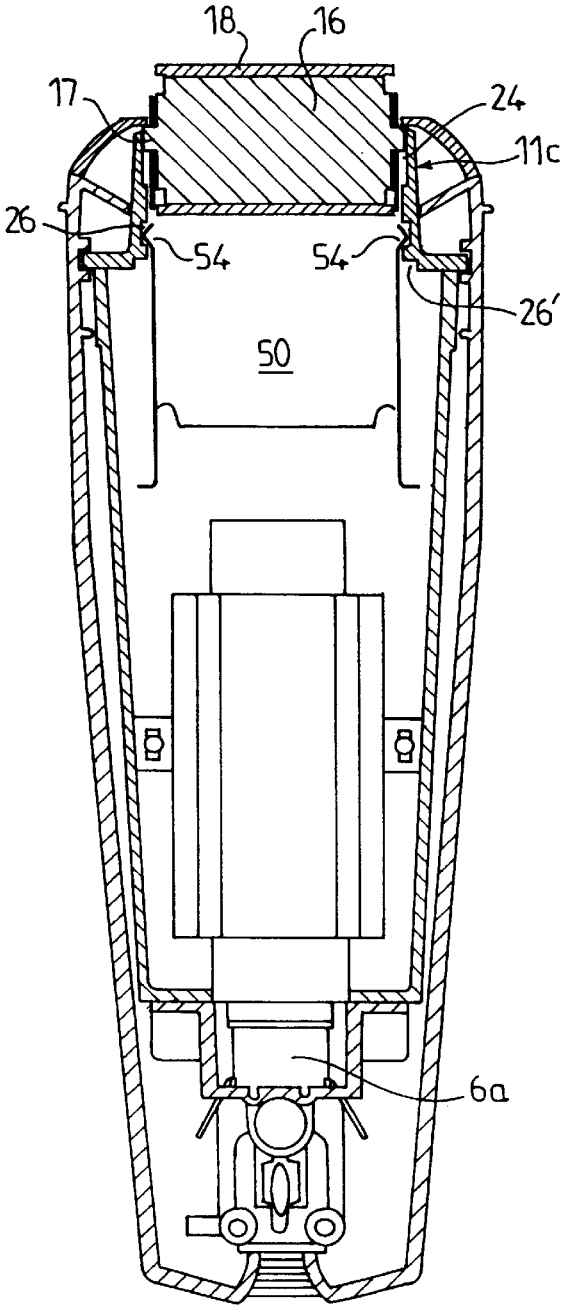
FIGS. 2*a* and 2*b* are views similar to those of FIGS. 1*a* and 1*b*, showing the same applicator in a position to apply a thick layer of wax.
Figure 2B:
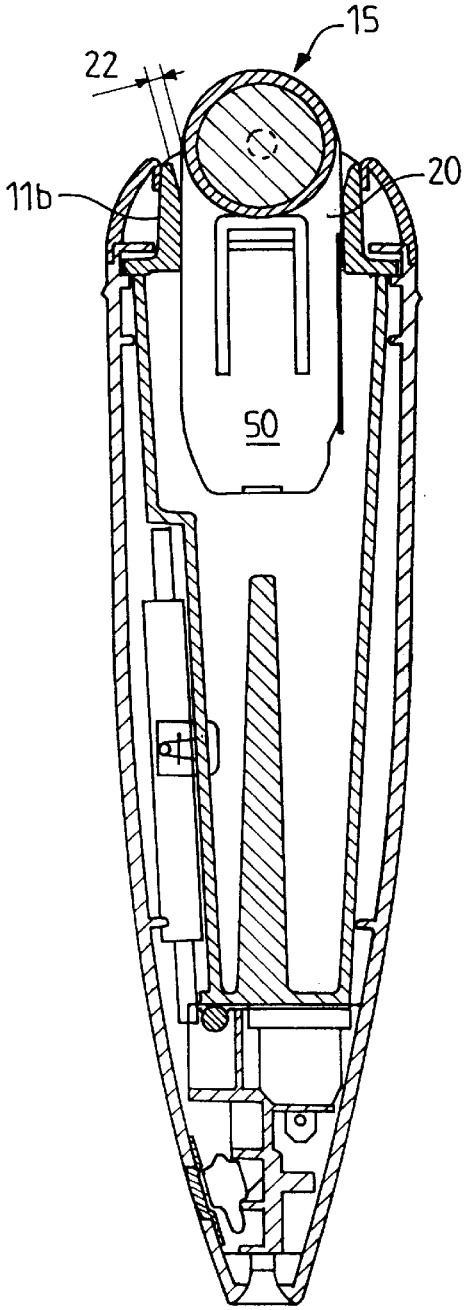

If, for a given zone, the user finds that the thickness of the layer is insufficient, the user can grasp the roller, preferably with the gripper in view of the high temperature of the roller, and exert a pulling force to cause the projections 54 to be displaced into a first pair of slit 22, as shown in FIGS. 2*a* and 2*b*. The thickness of slit 22 having been increased, the same is true for the thickness of the layer of wax leaving slit 22 to be deposited on the skin.

If the user pulls the roller further, for example, into a further pair of notches which are not illustrated, the thickness of slit 22 attains a maximum value at which it has practically no influence on the thickness of the layer deposited, the viscosity of the hot wax becoming the controlling parameter. However, large slit thicknesses can still prove useful for waxes having different compositions, possibly in combination with roller coverings of different materials.

Advantageously, the circular lateral faces of applicator roller 15 can be provided with a series of concentric circular rings of different colors varying, for example, from a blue color at the periphery to a bright red color at the center. The user can then refer to these markings to obtain an indication of the thickness of the wax layer that will be applied. For example, if the user only sees the blue ring, this indicates that the thickness of slit 22 is very small and there is no risk that the temperature of the skin will be raised to an uncomfortably or dangerously high temperature. Conversely, if the user can see the red ring, it will be understood that applicator roller 15 has been moved to its maximum protruding position with the thickness of slit 22 being large, so that the user must exercise greater care.

FIGS. 3*a*, 3*b*, 4*a* and 4*b* illustrate another embodiment of a mechanism for adjusting the height of applicator roller 15 within a slider 50' engaged in an head 11 by projections at the end of tongues which are not shown. This slider 50' is similar to the slider 50 previously described, and identical parts thereof are identified by the same reference numerals, apart from openings 59 at its upper extremity through which extend pins 17 of applicator roller 15. Openings 59 in the illustrated embodiment have an oblong shape with their larger dimension parallel to the longitudinal axis of the applicator.

Slider 50' is completed at the interior by a cam formed of two mutually parallel arms 61 which face one another and are rigidly connected together by a crosspiece 62, each arm being parallel to, and adjacent, a leg 51 of slider 50'. The two lower extremities of arms 61 are mounted for pivotal movement on pivots 63 which define a pivot axis transverse to the longitudinal axis of the applicator. The two upper extremities of arms 61 are provided with oblique openings 64 which are opposite openings 59 and through which pins 17 also pass. The external, or upper, ends of oblique openings 64 terminate in transverse notches. Each arm 61 is provided at the middle of its upper, or external, edge, with a grasping button, or finger, 65 which is located above head 11.

Figure 4A:
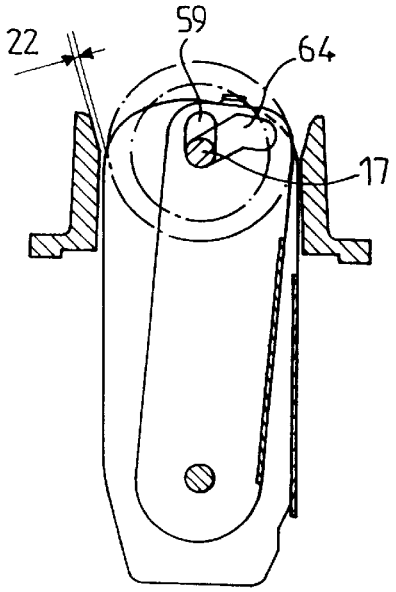
FIGS. 4*a* and 4*b* are views similar to those of FIGS. 3*a* and 3*b*, showing portions of the same applicator in a position for depositing a thin layer of wax.
Figure 4B:
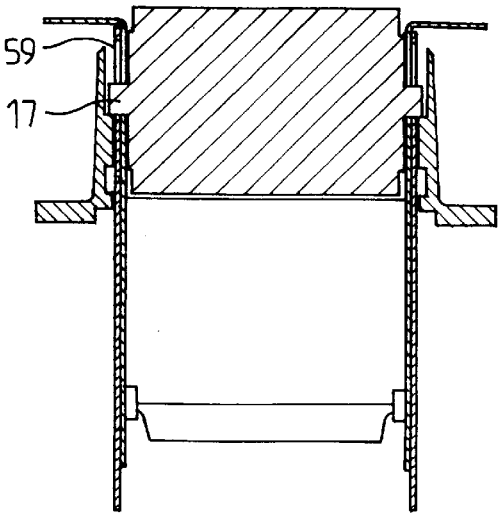

This mechanism functions in the following manner. When the cam 61/62 is pivoted toward the right, as shown in FIGS. 4*a* and 4*b*, openings 64 force pins to move downwardly toward the lower ends of openings 59. The pins 17 then rest at the bottom of grooves 24, applicator roller 15 then being in its lowered position and the thickness of slit 22 having its minimum value.

Figure 3A:
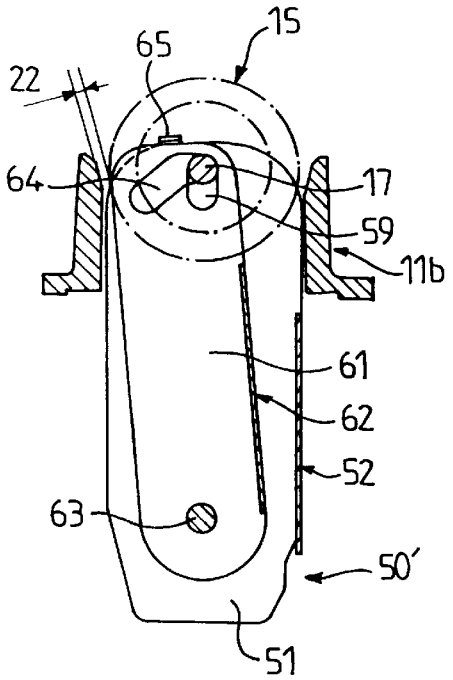
FIGS. 3*a* and 3*b* are cross-sectional detail views, from the side and front, respectively, of a portion of a second embodiment of an applicator according to the invention in a position to apply a thick layer of wax.
Figure 3B:
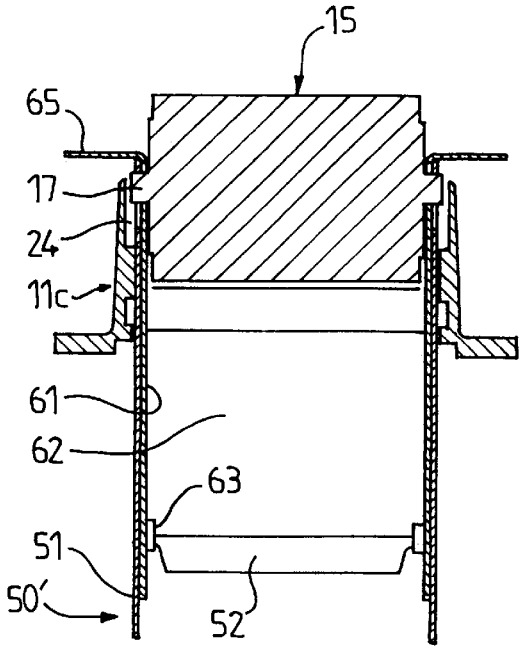

If the user grasps between the thumb and index finger one of the buttons 65, the user can move the button 65 in order to pivot the cam 61/62 to the opposite side, as shown in FIGS. 3*a* and 3*b*. During this pivoting, the openings 64, during a first phase, urge pins 17 upwardly to the upper ends of openings 59 and, in a second phase, cause pins 17 to enter the transverse notches so that applicator roller 15 is locked in its raised position. Applicator roller 15 being in its raised position with respect to longitudinal walls 11*b*, the thickness of slit 22 has its maximum obtainable value.

The invention is not in any way limited solely to the embodiments described herein, but encompasses numerous modifications and improvements. Particularly, other types of mechanisms can be envisioned for displacing pins 17. For example, this can be achieved by means of two lateral toothed wheels each maintained in a housing fixed to a respective lateral wall of the head, each wheel having a tapped central portion held in a threaded shank that carries, at its extremity, a bearing for supporting a respective roller pin.

It can also be envisioned that rotatable applicator roller 15 is fixed in height within the head and that, conversely to that described earlier herein, one or both of longitudinal walls 11*b* of head 11 are mounted on lower transverse carriages permitting their edges to move away from or toward applicator roller 15.

Moreover, it can be envisioned that the shield, or cap, covering head 11 (shown but not referenced in FIGS. 1*a*–2*b*) which primarily provides thermal protection for the user and contributes to the attractive appearance of the applicator, can be extended by one or several tongues which extend to the roller in order to partially close the length of the outlet slits. One thus obtains, in addition to an adjustment of the thickness of the slits, also an adjustment of their width, parallel to the plane of FIG. 1*a*, to obtain wax bands having a variable width that is selected in dependence on whether treatment is to be performed on the legs or the face.

The invention can equally be applied to an opening having a cross section which is no longer rectangular, but circular and at the interior of which one advances or retracts a needle.

It will be apparent that when an applicator according to the invention is being used to apply a layer of thermoplastic product, the product will exit through only the one slit 22 at which the peripheral surface of applicator roller 15 is advancing away from reservoir 2. Wax will not exit via the other slit 22, at which the peripheral surface of applicator roller 15 is advancing toward reservoir 2, due primarily to the relation between the viscosity of the melted product and the thickness of slit 22.

What is claimed is:

1. An applicator for a thermoplastic product, said applicator comprising:

a housing (1) constructed to be held by a user and having a longitudinal axis and an end provided with two mutually parallel longitudinal walls (11*b*) and two transverse walls (11*c*) delimiting a product outlet opening (20);

a reservoir (2) for holding the product, said reservoir being installed in said housing, being constructed to be in thermal communication with a heating means (4) and being open at one end to permit product in said reservoir to flow into said product outlet opening;

an applicator roller (15) located in said product outlet opening and having an axis of rotation which is parallel to said longitudinal walls; and means for displacing said applicator roller parallel to said longitudinal axis, wherein said applicator roller displacing means comprise a slider mounted in said housing and supporting said applicator roller; and detent means for holding said slider in a selected one of a plurality of positions which are spaced apart along said longitudinal axis.

2. The applicator according to claim 1 wherein said detent means comprise a first component in the form of at least one notch and a second component in the form of at least one projection engageable in said at least one notch, each of said component forming a part of a respective one of said slider and said transverse walls.

3. An applicator for a thermoplastic product, said applicator comprising:

a housing (1) constructed to be held by a user and having a longitudinal axis and an end provided with two mutually parallel longitudinal walls (11*b*) and two transverse walls (11*c*) delimiting a product outlet opening (20);

a reservoir (2) for holding the product, said reservoir being installed in said housing, being constructed to be in thermal communication with a heating means (4) and being open at one end to permit product in said reservoir to flow into said product outlet opening;

an applicator roller (15) located in said product outlet opening and having an axis of rotation which is parallel to said longitudinal walls; and means for displacing said applicator roller parallel to said longitudinal axis, wherein said applicator roller has bearing pins coaxial with the axis of rotation of said applicator roller;

said transverse walls are provided with grooves which extend parallel to said longitudinal axis for retaining said bearing pins; and said applicator roller displacing means comprise: a displacement member disposed in said housing and composed of two transverse arms and a crosspiece securing said arms together; and means supporting said displacement member for pivotal movement about an axis generally parallel to the axis of rotation of said applicator roller, each of said transverse arms having an elongate opening which is located adjacent a respective groove, extends obliquely to said longitudinal axis and retains a respective bearing pin.

4. The applicator according to claim 3 further comprising an intermediate slider mounted in said housing and provided with two elongated openings that extend parallel to said longitudinal axis and receive and guide said bearing pins.

5. The applicator according to claim 4 wherein each of said longitudinal walls has an upper edge and at least a wall portion which extends substantially parallel to said longitudinal axis, and said applicator roller displacing means are operative for displacing said applicator roller to a position at which the axis of rotation of said applicator roller is substantially in line with said upper edge of each of said longitudinal walls.

6. The applicator of claim 4 wherein each of said longitudinal walls has at least a wall portion which is inclined relative to said longitudinal axis.

7. The applicator of claim 3 wherein each of said longitudinal walls has an upper edge and at least a wall portion which extends substantially parallel to said longitudinal axis, and said applicator roller displacing means are operative for displacing said applicator roller to a position at which the axis of rotation of said applicator roller is substantially in line with said upper edge of each of said longitudinal walls.

8. The applicator of claim 3 wherein each of said longitudinal walls has at least a wall portion which is inclined relative to said longitudinal axis.

9. The applicator of claim 1 wherein each of said longitudinal walls has an upper edge and at least a wall portion which extends substantially parallel to said longitudinal axis, and said applicator roller displacing means are operative for displacing said applicator roller to a position at which the axis of rotation of said applicator roller is substantially in line with said upper edge of each of said longitudinal walls.

10. The applicator of claim 1 wherein each of said longitudinal walls has at least a wall portion which is inclined relative to said longitudinal axis.

* * * * *